US007086957B2

(12) United States Patent
Solheim et al.

(10) Patent No.: US 7,086,957 B2
(45) **Date of Patent: *Aug. 8, 2006**

(54) GOLF PUTTER HEAD WITH A VISUAL ALIGNMENT AID AND AN INCREASED MOMENT OF INERTIA

(75) Inventors: John A. Solheim, Phoenix, AZ (US); David D. Jones, Phoenix, AZ (US); Derek W. Haines, Beaverton, OR (US); John K. Solheim, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/210,934

(22) Filed: Aug. 23, 2005

(65) Prior Publication Data

US 2005/0282657 A1 Dec. 22, 2005

Related U.S. Application Data

(63) Continuation of application No. 10/758,654, filed on Jan. 15, 2004, now Pat. No. 6,960,140.

(51) Int. Cl.
*A63B 53/04* (2006.01)
*A63B 69/36* (2006.01)

(52) U.S. Cl. ..... 473/251; 473/340

(58) Field of Classification Search ..... 473/324–350, 473/251–256; D21/736–746, 759
See application file for complete search history.

(56) References Cited

U.S. PATENT DOCUMENTS

D58,209 S 6/1921 Bacheller
D163,083 S 5/1951 Belline
2,954,231 A 9/1960 MacIntyre
D218,178 S 7/1970 Solheim
D230,869 S 3/1974 Winter
D234,960 S 4/1975 Swash
D235,668 S 7/1975 Swash
D238,285 S 12/1975 Ross
4,010,958 A 3/1977 Long
D255,373 S 6/1980 Solheim
4,444,395 A 4/1984 Reiss
D282,952 S 3/1986 Mattingly
4,688,798 A 8/1987 Pelz
4,815,739 A 3/1989 Donica
5,058,895 A 10/1991 Igarashi
5,080,365 A 1/1992 Winchell
5,116,047 A 5/1992 Phelan
5,160,141 A 11/1992 Crews
D334,039 S 3/1993 Tanaka
5,213,332 A 5/1993 Fahy et al.
D337,803 S * 7/1993 Sillers ..... D21/741

(Continued)

*Primary Examiner*—Sebastiano Passaniti
(74) *Attorney, Agent, or Firm*—Darrell F. Marquette

(57) ABSTRACT

A golf putter head includes a face member with a front surface arranged for impacting a golf ball. A first arm extends substantially rearwardly from a heel end of the face member, a second arm extends substantially rearwardly from a toe end of the face member, and a central member extends rearwardly from the face member intermediate the heel and toe ends thereof. The central member is connected to and extends rearwardly from a back surface of the face member. The central member is connected to the first and second arms rearwardly of the face member. The first and second arms have top surfaces that slope downwardly as the first and second arms extend away from the face member.

7 Claims, 2 Drawing Sheets

U.S. PATENT DOCUMENTS

| | | | | |
|---|---|---|---|---|
| D341,405 | S | 11/1993 | Solheim | |
| 5,282,622 | A | 2/1994 | Evans | |
| 5,482,281 | A | 1/1996 | Anderson | |
| D379,484 | S | 5/1997 | Solheim | |
| 5,630,765 | A | 5/1997 | Moore | |
| D380,029 | S | 6/1997 | Anderson | |
| 5,749,791 | A | 5/1998 | Passeri | |
| D399,911 | S | 10/1998 | Nicolette et al. | |
| 5,820,481 | A | 10/1998 | Raudman | |
| 5,830,078 | A | 11/1998 | McMahan | |
| D402,722 | S | 12/1998 | Rollinson | |
| 5,842,935 | A | 12/1998 | Nelson | |
| D405,137 | S | 2/1999 | Nelson | |
| 5,871,407 | A | 2/1999 | Tseng | |
| D410,717 | S | 6/1999 | Anderson | |
| D411,271 | S | 6/1999 | Nelson | |
| 5,916,035 | A | 6/1999 | Caiozzo | |
| 6,017,280 | A | 1/2000 | Hubert | |
| 6,059,669 | A | 5/2000 | Pearce | |
| 6,080,070 | A | 6/2000 | Whitley | |
| D437,017 | S | 1/2001 | Ford | |
| D444,833 | S | 7/2001 | Wells et al. | |
| D449,865 | S | 10/2001 | Fife | |
| D451,973 | S | 12/2001 | Wells et al. | |
| 6,350,208 | B1 | 2/2002 | Ford | |
| D460,990 | S | 7/2002 | Jung | |
| D461,860 | S | 8/2002 | Tang | |
| 6,471,600 | B1 | 10/2002 | Tang | |
| D472,949 | S | 4/2003 | Serrano | |
| D474,821 | S | 5/2003 | Wells et al. | |
| D484,935 | S | 1/2004 | Tang | |
| D485,321 | S | 1/2004 | Breier | |
| D488,526 | S | 4/2004 | Souza et al. | |
| D493,857 | S | 8/2004 | Cameron | |
| D496,417 | S | 9/2004 | Tang | |
| D496,418 | S | 9/2004 | Tang | |
| 6,796,911 | B1 | 9/2004 | Grace | |
| D499,778 | S | 12/2004 | Cameron | |
| D500,109 | S | 12/2004 | Solheim et al. | |
| D500,110 | S | 12/2004 | Solheim et al. | |
| 6,837,801 | B1 | 1/2005 | Souza et al. | |
| 6,893,355 | B1 | 5/2005 | Souza | |
| 6,960,140 | B1 * | 11/2005 | Solheim et al. | 473/251 |
| 6,966,845 | B1 * | 11/2005 | Solheim et al. | 473/251 |
| 2003/0144077 | A1 | 7/2003 | Cullen | |
| 2003/0228925 | A1 | 12/2003 | Rohrer | |
| 2005/0159240 | A1 | 7/2005 | Solheim et al. | |
| 2005/0159242 | A1 | 7/2005 | Solheim et al. | |

* cited by examiner 10
26
14
22
24
56
54
58
33
12
32
20
36
16
36a
60
38
52
35
37
34
50
40
58
62

26
14
24
60
62
12
22
54
16
32
34
38
36
37
40

16
12
58
18
26
22
14
28
30

26
24
12
35
18
37
36
34

26
12
24
18
35
37
32
36

10
26
24
12
54
58
18
14
16
10a
10b
42
50
44
32
60
62
33
35
36
34
36a
52
38
46
40
48
10c
37

10
12
18
24
16
14
10b
44
36
42
10a
34
32
38
40
10c
37

GOLF PUTTER HEAD WITH A VISUAL ALIGNMENT AID AND AN INCREASED MOMENT OF INERTIA

BACKGROUND OF THE INVENTION

This is a continuation of application Ser. No. 10/758,654 filed Jan. 15, 2004 now U.S. Pat. No. 6,960,140.

This invention relates generally to golf equipment and, in particular, to a golf putter head with a visual alignment aid and an increased moment of inertia.

Recent developments in golf equipment have resulted in golf putter heads with high moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of heavyweight material such as bronze or steel. An upper shell-like member, preferably made of lightweight material such as plastic or aluminum, is secured to the lower plate-like material to enclose the heel and toe weights. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15% of the total weight of the putter head while constituting more than 50% of the total volume of the putter head.

SUMMARY OF THE INVENTION

The present invention provides a golf putter head including a face member having a heel end, a toe end, a top rail, a front surface arranged for impacting a golf ball, and a back surface. A first arm extends substantially rearwardly from the heel end of the face member, and a second arm extends substantially rearwardly from the toe end of the face member. A central member is connected to and extends rearwardly from the back surface of the face member intermediate the heel and toe ends thereof. The central member is connected to the first and second arms rearwardly of the face member. The central member and the first arm define a first opening therebetween adjacent the heel end of the face member while the central member and the second arm define a second opening therebetween adjacent the toe end of the face member. The first and second arms have top surfaces that slope downwardly as the first and second arms extend away from the face member.

DESCRIPTION OF THE PREFERRED EMBODIMENT

Figures 1, 2, 3, 4, 5:
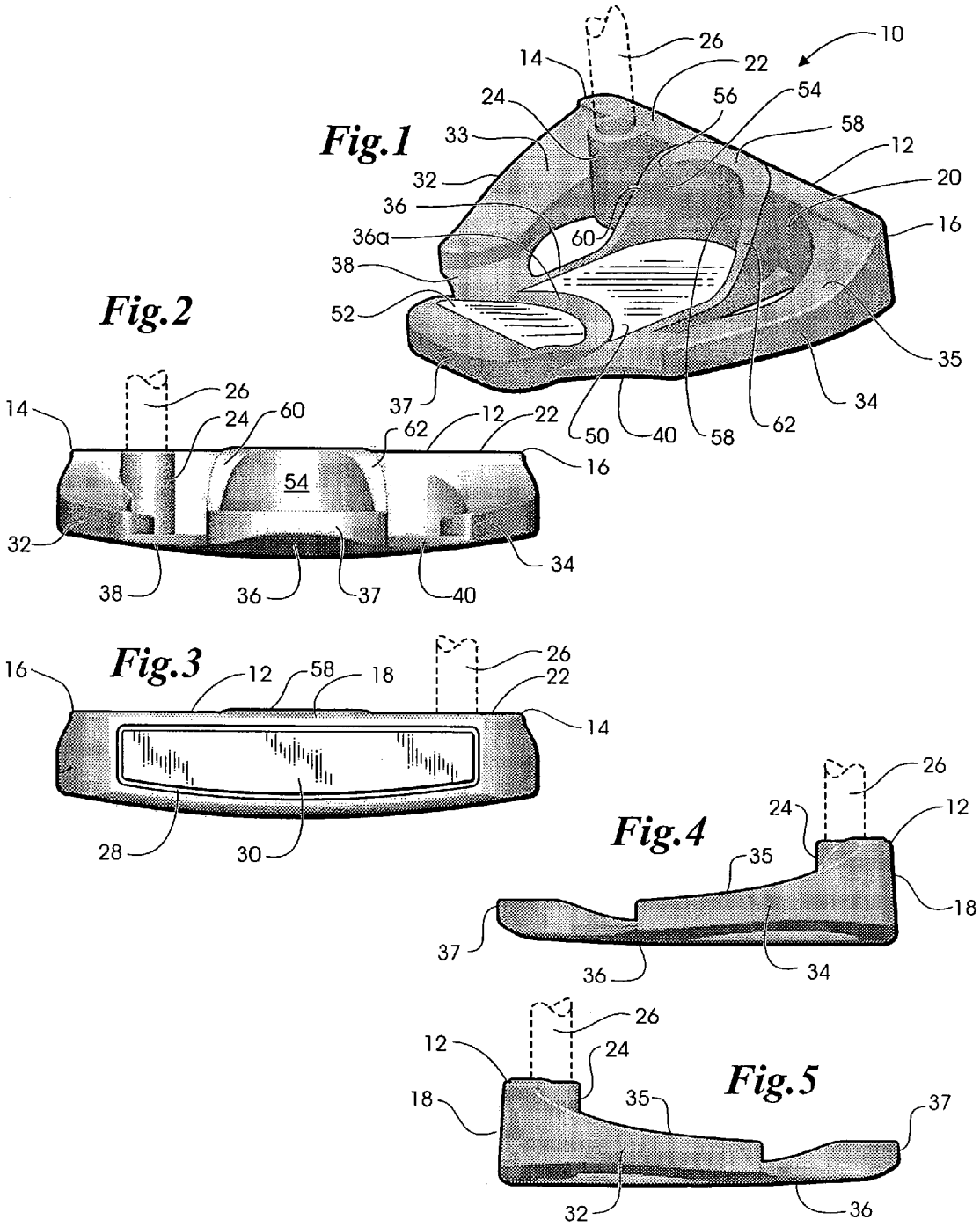
FIG. 1 is a perspective view of a golf putter head according to the preferred embodiment of the present invention.
FIG. 2 is a rear elevational view of the golf putter head shown in FIG. 1.
FIG. 3 is a front elevational view of the golf putter head shown in FIG. 1.
FIG. 4 is a toe end view of the golf putter head shown in FIG. 1.
FIG. 5 is a heel end view of the golf putter head shown in FIG. 1.

Referring to FIGS. 1–3, a golf putter head 10 includes a face member 12 with a heel end 14, a toe end 16, a front surface 18 arranged for impacting a golf ball, a back surface 20 and a top rail 22. A hosel 24 is disposed near the heel end 14 of the face member 12. A shaft 26 has its lower end received in the hosel 24 and fixed therein by a suitable adhesive. As disclosed in U.S. patent application Ser. No. 10/632,580 filed Jul. 31, 2003 and incorporated herein by reference, the front surface 18 of the face member 12 has a recess 28 formed therein, and a face plate 30, preferably made of an elastomeric material such as polyurethane, is disposed in the recess 28.

Figure 6:
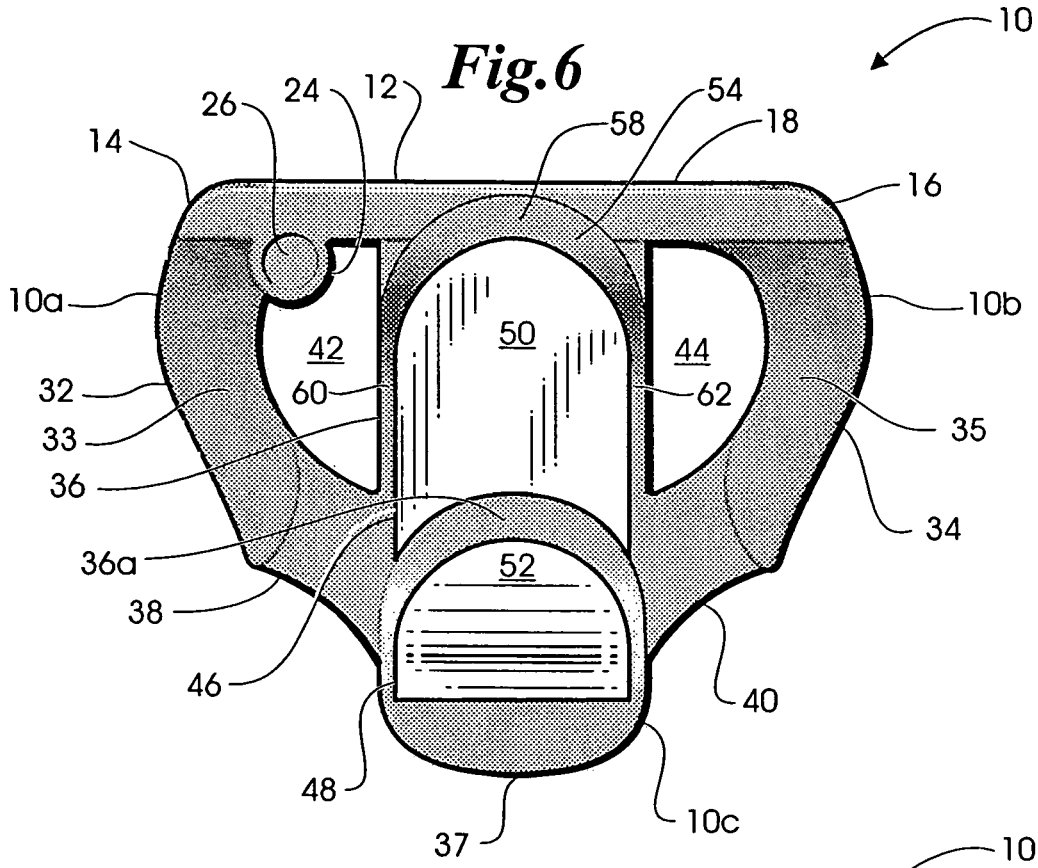
FIG. 6 is a top plan view of the golf putter head shown in FIG. 1.
Figure 7:
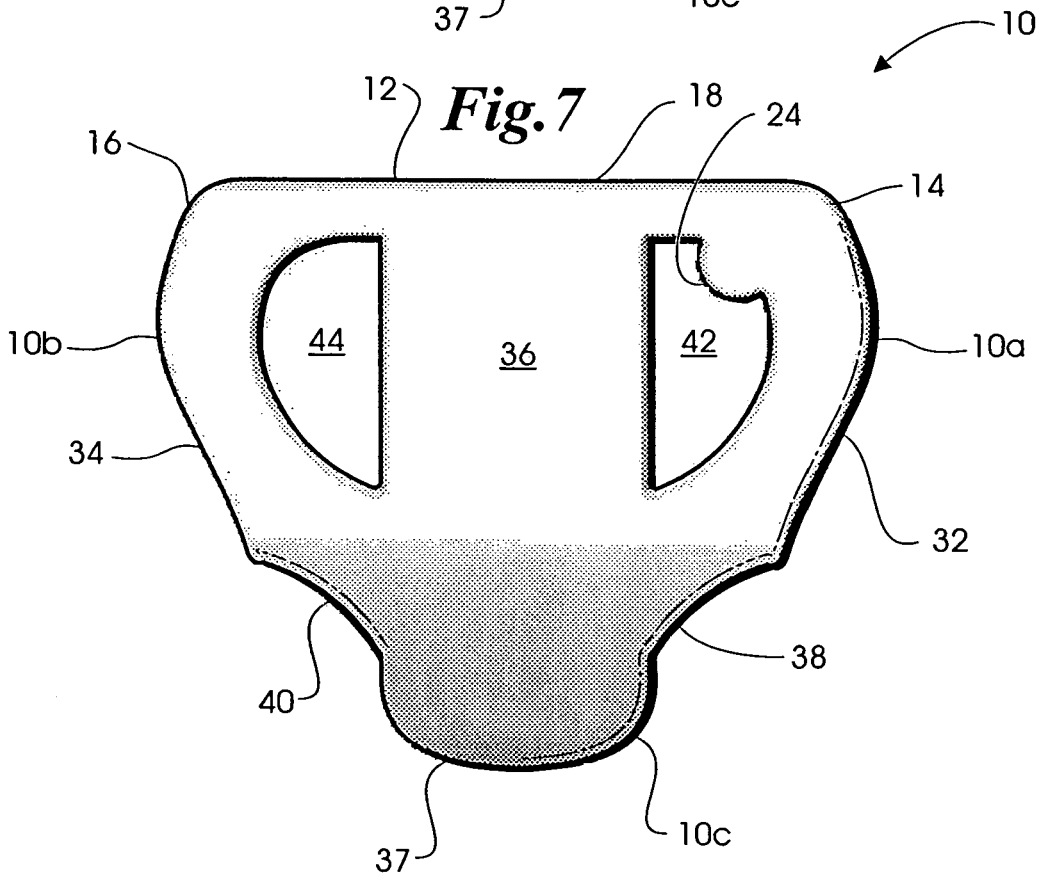
FIG. 7 is a bottom view of the golf putter head shown in FIG. 1.

As also shown in FIGS. 6 and 7, a first arm 32 extends substantially rearwardly from the heel end 14 of the face member 12 while a second arm 34 extends substantially rearwardly from the toe end 16 of the face member 12. A central member 36 extends rearwardly from the face member 12 intermediate the heel and toe ends 14, 16 thereof. The face member 12, the first and second arms 32, 34 and the central member 36 are preferably formed of a first material such as steel.

The central member 36 includes a pair of wing portions 38, 40 connecting the central member 36 to the first and second arms 32, 34 rearwardly of the face member 12. A first opening 42 is defined between the central member 36 and the first arm 32 adjacent the heel end 14 of the face member 12, and a second opening 44 is defined between the central member 36 and the second arm 34 adjacent the toe end 16 of the face member 12. These openings 42, 44 cause more weight to be located near end portions 10*a*, 10*b* and back portion 10*c* of the putter head 10 which increases the moment of inertia of the putter head 10. The central member 36 includes a thickened portion 37 adjacent putter head back portion 10*c*. This thickened portion 37 also causes more weight to be located near the back portion 10*c* of the putter head 10 further increasing the putter head moment of inertia.

A first cavity 46 having a depth of approximately 0.089 inch is formed in an upper surface 36*a* of the central member 36 between the openings 42, 44. A second cavity 48 having a depth of approximately 0.149 inch is formed in the upper surface 36*a* of the central member 36 rearwardly of the first cavity 46 and rearwardly of the openings 42, 44. First and second inserts 50 and 52 having respective thicknesses of approximately 0.074 and 0.134 inch are disposed, respectively, in the first and second cavities 46 and 48. Double sided adhesive tape (not shown) having a thickness of approximately 0.015 inch is used to secure the first and second inserts 50, 52 in the first and second cavities 46, 48. The first and second inserts 50, 52 are preferably formed of a second material, such as urethane, that is less dense than the first material from which the face member 12, the arms 32, 34 and the central member 36 are formed. The first cavity 46 and the first insert 50 each have a generally elongated crescent shape with a concave end while the second cavity 48 and the second insert 52 each have a generally semicircular shape with a convex side.

In order to provide a visual alignment aid, the convex sides of the second recess 48 and the second insert 52 are aligned with and complement the concave ends of the first recess 46 and the first insert 50. Since the first and second inserts 50, 52 are aligned in a direction that is substantially perpendicular to the front surface 18 of the face member 12, the visual alignment aid is lengthened. The first and second inserts 50, 52 have a color which contrasts with the face member 12, the first and second arms 32, 34 and the central member 36 to enhance the visual alignment aid.

The central member 36 has a substantially U-shaped wall 54 at one end thereof that merges with the back surface 20 of the face member 12. Formed at the other end of the central member 36 opposite the wall 54 is the thickened portion 37. The wall 54 has a top edge 56. A middle portion 58 of the wall top edge 56 is curved and protrudes slightly above the top rail 22 of the face member 12. As an alternative, the middle portion 58 of the top wall edge 56 may be recessed slightly below the top rail 22. Opposed side portions 60, 62 of the wall top edge 56 slope downwardly from the middle portion 58 as the wall 54 extends away from the face member 12. The arms 32, 34 have top surfaces 33, 35 that slope downwardly as the arms 32, 34 extend away from the face member 12.

Alternatively, the hosel 24 could be eliminated and a hole (not shown) could be formed in the arm 32 for receiving the lower end of the shaft 26. Also, the recess 28 and the face plate 30 could be eliminated from the front surface 18 of the face member 12.

What is claimed is:

1. A golf putter head comprising:

a face member having a heel end, a toe end, a top rail extending between the heel and toe ends, a front surface arranged for impacting a golf ball, and a back surface;

a first arm extending generally rearwardly from the back surface of said face member at the heel end thereof;

a second arm extending generally rearwardly from the back surface of said face member at the toe end thereof;

a central member having an inner end connected to the back surface of said face member intermediate the heel and toe ends thereof, said central member extending rearwardly from said face member and being connected to said first and second arms rearwardly of said face member;

said central member and said first arm defining a first opening that extends through the golf putter head adjacent the heel end of said face member;

said central member and said second arm defining a second opening that extends through the golf putter head adjacent the toe end of said face member;

said central member including a first cavity in its upper surface located between said first and second openings; and said central member further including a second cavity in its upper surface located rearwardly of said first cavity.

2. The golf putter head of claim 1, wherein said first and second arms are curved and wherein said central member is straight.

3. The golf putter of claim 1, further comprising a face plate disposed in the front surface of said face member.

4. The golf putter head of claim 1, further comprising a hosel disposed adjacent the heel end of said face member for receiving a shaft.

5. The golf putter head of claim 1, wherein the front and back surfaces of said face member arc substantially parallel to each other.

6. The golf putter head of claim 1, wherein said first and second arms have top surfaces that slope downwardly as said first and second arms extend away from said face member.

7. The golf putter head of claim 1, wherein said central member includes a pair of wing portions connecting said central member to said first and second arms.

* * * * *